US010870518B2

(12) United States Patent
Löfholm et al.

(10) Patent No.: US 10,870,518 B2
(45) Date of Patent: Dec. 22, 2020

(54) DISPOSABLE LID FOR BEVERAGE CONTAINERS

(71) Applicant: UniCup Scandinavia AB, Huddinge (SE)

(72) Inventors: Håkan Johan Löfholm, Huddinge (SE); Lars Bendix, Randers NÖ (DK)

(73) Assignee: Unicup Scandinavia AB, Huddinge (SE)

( * ) Notice: Subject to any disclaimer, the term of this patent is extended or adjusted under 35 U.S.C. 154(b) by 112 days.

(21) Appl. No.: 16/314,211

(22) PCT Filed: Jan. 31, 2018

(86) PCT No.: PCT/SE2018/050071
§ 371 (c)(1),
(2) Date: Dec. 28, 2018

(87) PCT Pub. No.: WO2018/147783
PCT Pub. Date: Aug. 16, 2018

(65) Prior Publication Data

US 2019/0217997 A1 Jul. 18, 2019

(30) Foreign Application Priority Data

Feb. 8, 2017 (SE) ..... 1750119

(51) Int. Cl.
*B65D 43/02* (2006.01)
*B65D 47/04* (2006.01)
*B65D 47/06* (2006.01)

(52) U.S. Cl.
CPC ..... *B65D 43/0212* (2013.01); *B65D 43/02* (2013.01); *B65D 47/043* (2013.01);
(Continued)

(58) Field of Classification Search
CPC .. B65D 43/02; B65D 43/021; B65D 43/0212; B65D 47/043; B65D 6/0804;
(Continued)

(56) References Cited

U.S. PATENT DOCUMENTS 4,202,459 A 5/1980 DeParales et al.
2005/0072787 A1 4/2005 Morris et al.
(Continued)

FOREIGN PATENT DOCUMENTS

WO 2009/055067 A2 4/2009
WO 2016/115176 A1 7/2016

OTHER PUBLICATIONS

International Search Report and Written Opinion dated Apr. 12, 2018 issued in corresponding PCT Application No. PCT/SE2018/050071 consisting of 9 pages.

*Primary Examiner* — Don M Anderson
(74) *Attorney, Agent, or Firm* — Christopher & Weisberg, P.A.

(57) ABSTRACT

A disposable lid for containers with beverages, especially hot beverages, such as coffee and tea. The disposable lid has an open part where a compartment is created, enabling a person to drink directly from the top of the container, and where the compartment is limited by a floor. One embodiment includes an integrated filter with narrow slits to hinder particles, such as coffee grains or tea leaves from entering the mouth of the consumer of the beverage. Another embodiment includes an arrangement to slow down the beverage flow entering the drinking compartment, and optionally includes a cooling surface for the beverage. The lid may be provided with an auxiliary lid to be attached to reduce the spilling risk to a minimum.

20 Claims, 20 Drawing Sheets

(52) U.S. Cl.
CPC .... *B65D 47/06* (2013.01); *B65D 2543/00046* (2013.01); *B65D 2543/00092* (2013.01); *B65D 2543/00342* (2013.01)

(58) Field of Classification Search
CPC ..... B65D 2543/00046; B65D 2543/00342; B65D 2547/066
See application file for complete search history.

(56) References Cited

U.S. PATENT DOCUMENTS

| | | | | |
|---|---|---|---|---|
| 2008/0156817 | A1* | 7/2008 | Roseblade ..... | A47G 19/2211 220/713 |
| 2008/0257899 | A1 | 10/2008 | Whitaker et al. | |
| 2010/0133272 | A1 | 6/2010 | Whitaker et al. | |
| 2015/0196149 | A1 | 7/2015 | Savenok | |
| 2015/0201777 | A1* | 7/2015 | Kim ..... | A47G 23/0216 220/713 |

* cited by examiner

DISPOSABLE LID FOR BEVERAGE CONTAINERS

CROSS-REFERENCE TO RELATED APPLICATIONS

This application is a Submission Under 35 U.S.C. § 371 for U.S. National Stage Patent Application of International Application Number: PCT/SE2018/050071, filed Jan. 31, 2018 entitled "A DISPOSABLE LID FOR BEVERAGE CONTAINERS," which claims priority to SE1750119-8, filed Feb. 8, 2017 entitled "A DISPOSABLE LID FOR BEVERAGE CONTAINERS" the entirety of both of which are incorporated herein by reference.

TECHNICAL FIELD

The present invention relates to the field of lids for beverage containers, in particular it relates to an improved disposable lid for beverage containers.

BACKGROUND

Since the 1930's disposable lids for beverage containers have been in used. A disposable lid is defined as a low cost device to be attached on the top of a beverage container. Low cost in this aspect means a lid for a beverage container that can be disposed without any significant cost for the seller or buyer, regarding ordinary drinks, such as coffee, tea, soda, water, etc. The container is normally a paper cup, Styrofoam cup, or other cups and mugs.

The primary function of a disposable lid for beverage containers is to prevent the beverage to unintentionally be spilled. The first lids where just lids with no opening, which means that the lid had to be taken off before consuming the content of the container, a process that could introduce spillage, especially if the environment is not still, such as in a car or other transportation means. For this reason, it has been a demand for disposable lids that do not need to be removed before drinking. One early solution was to peel off a part of the lid where the mouth was intended to meet the container as shown U.S. Pat. No. 4,215,793 A. However, this prior art lid has many advantages and problems. First, there is no restriction of the beverage flow which means that unnecessary large amount of hot beverages can unintentionally be consumed and burn the lips or mouth of the consumer. Also, the relatively large opening for the mouth is a risk for spill. Even during the peeling off of the removable part there is a risk for spillage of the content of the cup, due to the fact that there can be sudden movements during the peeling off.

To avoid problems with a large opening, a raised structure was developed with a lid that surrounds the container's rim, the lid comprising a raised part or an upwardly extended spout through which the contents of the cup is caused to flow as described and shown in U.S. Pat. No. 4,345,695 A. This spout, even if it is rather small, gives for hot beverages a stream of fluid that can easily burn the mouth. Moreover, the beverage has to be over the level of the cup's rim, which means there is a risk for spillage. Paper cups have almost always a seam that is not even, and hence is prone to leak if the beverage is over the top of the cup. A more catastrophic situation, which is not uncommon, is when the lid and cup separates, introducing a major leakage, which in case of a hot beverage, can be harmful. The spout can in some configurations be closed reducing the risk for spill during transportation, but the problem remains when the spout is in use during consumption of the contents of the container.

There are many problems to be solved for a disposable lid for a cup or container. One of the most important limitations is cost. It has to be cost efficient but still functional. The cost limitation often reduces the lid to be made of a polymer in one part. There are different issues that have to be addressed, and due to the cost limitation, all issues are difficult to solve in one solution. A choice of which problems to be solved must be prioritized. For non-disposable lids, the situation is different, where sophisticated and expensive solutions can be achieved. Packaging is also an issue that is not a property of the function, but of storage and transportation. To solve this, a cup lid is preferably stackable, leaving fewer options for functions. Properties to be solved is, leak proof during transportation, leak proof during drinking, leak proof after use if there are beverage residues etc. One of the most inconvenient and dangerous hazards is the risk to be burned by hot beverages. Wanted properties can be to making coffee or tea directly in the cup, without letting the coffee grains or tea leaves to enter the mouth during drinking. For pleasure, it is important to have the right feel for the mouth and lips, preferably close to an open coffee cup and where aromas can flow freely to the nose. A preferable solution is where a person can sip, or rather slurp, mixing a hot beverage with cold air to reduce the risk for burn or uncomfortable heat.

Coffee is typically made at 92 to 97 centigrade for best results. Drinking temperature for best aroma is typically 62 to 67 centigrade. A drinking temperature above 70 centigrade is uncomfortable and can be dangerous due to the risk of burns. Prior art of disposable lids cannot solve the listed problems with too hot beverages.

SUMMARY

In view of the shortcomings of prior art described above, the invention solves several problems and provide several features. These solutions and features are achieved by the lid as claimed in claim 1 by a disposable lid for a container intended for beverage(s) comprising a seal and a fastener to be placed on the top of said container, the lid forming an open compartment wholly or partly inside said container, and said compartment is positioned below said top of said container, and where said compartment extends to the top of said seal, and said compartment is provided with a floor with a plurality of openings, enabling the beverage to pass through the openings, and the compartment is partly open to the wall of said container, when the lid is inserted, enabling a person's lips to be in contact with said top of said container during consumption of the beverage.

The invention allows a natural feel of drinking beverages from a container, e.g. a cup or a mug, due to the open structure at the position where the mouth (or lips) meets the container. A common problem with leakage and spill at the interface between container and lid is eliminated due to the fact that the drinker of the beverage drinks directly at the top of the container, e.g. at the rim of a cup. Small openings of the compartment in the lid which is placed at the drinking position, reduces the free flow of liquid, reducing the risk of burn and heat from the beverage, and also reducing the spill upon rapid movement of the container. Another advantage is that the beverage level being under the rim of the container, is that it is leading to smaller angle of the container during drinking instead to the beverage reaching a level over the rim of the container and hence a larger angle of tilting the container is necessary.

The invention includes several embodiments with special features. One embodiment with long and closely spaces openings or slits, restricting particles contained in the coffee or tea such as coffee grains or tea leaves, to pass and hence acting as a permeable filter.

According to another embodiment there is provided a protrusion in the floor of the compartment, but below the top of the container, allowing the beverage to be trapped on the floor and hence be cooled down during the drinking process.

DETAILED DESCRIPTION

Figure 1:
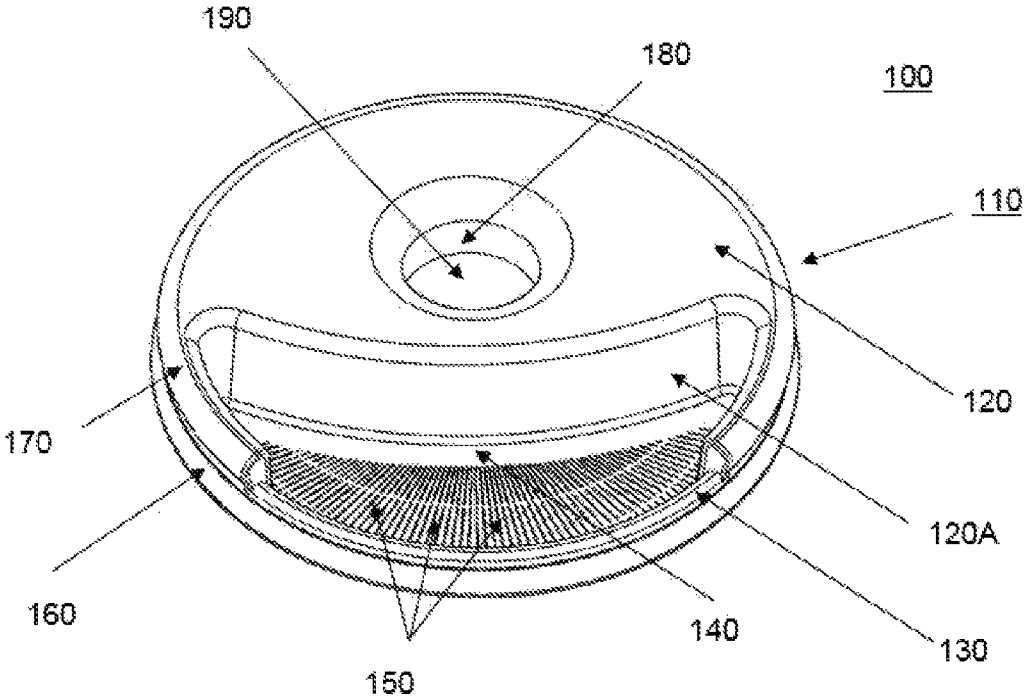
FIG. 1. Lid with slits, top-side view.

In the following, a detailed description of the exemplary embodiments is presented in conjunction with the drawings to enable easier understanding of the solutions(s) described herein.

The invention discloses a disposable lid, which according to an embodiment may be produced in one part. In another embodiment the lid may be made of multiple parts. The lid may be made of an environmental friendly material, for example polymers, such as PLA (poly lactide acid or polylactide), PP (polypropylene), PS (polystyrene), PE (polyethylene), ABS (acrylonitride butadiene styrene) etc. The lid may be made by injection molding of polymers, but vacuum forming, and other methods may also be used.

According to embodiments herein the lid comprises an open portion at the position for the mouth at the container, where the open portion, together with the wall of the container forms a compartment which is the place where beverage is ready for drinking. In one embodiment the compartment is occupying a part of the inner space of the container when placed on the contained, in another embodiment the compartment fills the whole or almost the whole inner area of the container. The drinking compartment can fill an arbitrary space inside the container. The less quantity of beverage in the container, the more the container has to be tilted for the beverage to reach the top of the container. At large tilting angles the nose will be close to the inner part of the lid.

The height of the compartment is chosen so the upper lip of the consumer can comfortably be placed inside the container during the drinking procedure. Therefore the floor of the compartment is lower than the top or rim of the container. A suitable height is approximately 5 to 15 mm, preferably 7 to 13 mm. A too deep compartment will infringe on the beverage space, and hence reduce the amount of beverage that can be filled in the container.

The floor of the compartment is equipped or provided with openings to allow the beverage to flow between the container and the compartment. One embodiment has a large area with small openings acting as a filter for particles such as coffee grains or tea leaves. The restrictions in the floor for that specific embodiment is primarily to hinder the particles, not the flow of beverage. According to another embodiment, the openings are small enough for reducing the flow of beverage, hence reducing the risk for burns and spill. The openings may have different forms as will be described in conjunction with some of the figures. According to another embodiment, there is provided another minor compartment inside the main compartment, described above, enabling beverage to be trapped and enabling a hot beverage too cool off. The invention is not limited by these embodiments.

When drinking hot beverages the drinking speed is naturally slow. The natural behavior is to "sip". The amount to sip is normally between 5 and 10 ml, smaller for hotter beverages. For a very fast drinker, a sip of 10 ml every 3 seconds, gives 1 minute to drink 2 dl. A more normal drinker takes a 5 ml sip every 15 seconds, which gives 10 minutes for 2 dl. This means that the flow rate of beverages passing the lid can be very slow without affecting the natural feeling of drinking.

Referring to FIG. 1 there is illustrated a schematic top perspective view of a disposable lid according to an embodiment herein. The lid is suitable for beverage container(s) that may be acquired in coffee or tea shops and/or drink stores which sell carry-out drinks. The lid 100 comprises an annular cover portion 110 for covering an opening at an open end or top or rim 210 (FIG. 2) of a container 200. The lid 100 maybe snapped on the top 210 of the container 200 by means of a seal 170 and a fastener 160. The seal 170 may be defined as an outer peripheral edge of the annular cover portion 110 and the fastener 100 may be defined as a peripheral side wall portion disposed around the seal 170. The fastener 160 secures that the lid 100 is fixed to the top 210 of the container 200 by having a smaller diameter than the top 210. Preferably the fastener 160 surrounds the container 200, to securely ensure that the lid 100 is strongly attached to the container 200. However, in one embodiment the fastener 160 does not necessarily have to surround the container. According to an embodiment, the part of the lid 100 that is on the top of the container 210, i.e. the seal 170, is open 130 at a portion where a person drinks with the mouth. The opening 130 may be viewed as a cut out portion of the seal 170 though which a portion of the top 210 of the container 200 is introduced or inserted. This portion allows the consumer to have lips contact directly with the container 200.

The disposable lid 100 forms a compartment (see e.g. 145 in FIG. 5*a* or 5*b*) provided with a floor 140 and openings 150. The floor 140 is positioned below the top 120 of the lid 100, and hence below the top 210 of the container 200 when in place. In this embodiment, the openings 150 form slits extending radially towards a wall 120A of the compartment 145 or lid 100. The slits are narrow. Using narrow slits means that coffee grains will be hindered to pass the slits during consumption of the beverage. Using slits instead of holes means that there will be free passage for liquid between the grains even if coffee grains are stacked together. Because coffee grains can more or less clog the slits, a large filter area is preferable, e.g. preferably larger than 25% of the horizontal cross section area of the container 200, but this is not a limit or a requirement. A useful slit width narrow typical openings between 0.1 mm to 0.5, mm preferable between 0.2 mm to 0.4 mm.

According to an embodiment, the slits 150 are distributed over an area, between 5% and 100% of said container's 200 horizontal area at said floor 140 portion, preferably larger than or equal to 20% of the horizontal top area of said container 200. According to an embodiment, the slits 150 are wedge-formed in the direction up to down, where the wedge of slits 150 has the largest dimension upwards, and the wedge angles of slits 150 is between 70 and 90 degrees, preferably between 75 and 85 degrees. According to an embodiment, when the lid is put on the container 200, the slits are positioned at about 3 mm from the container wall 200. The slits 150 maybe an integrated art of the lid 100.

The slits 150 can be created by ribs which are preferably connected to each other at certain distances, typically between 5 and 20 mm, for stability of the slit width, due to small dimensions. If the slits are not stabilized the ribs may bend with varying slit dimensions as a result. According to an exemplary embodiment the connections between ribs are 8.5 mm, but this not a limit or requirement. As previously described the floor 140 is connected to the top 120 of the lid 100 by wall 120A, and the lid 100 has an opening 130 where the lips touch the rim 210 of the container 200. The wall of the container 200 act as a wall of the compartment 145.

As shown in FIG. 1, the lid 100 may comprise an opening 190 formed by a protrusion 180 or wall or tube 180 extending inwards the container 200 for facilitating filling the beverage container with food additives e.g. hot water, sugar, coffee, tea, etc. The lid 100, preferably, has thinner dimensions at edges making the material seal better at the open part 130, or making the material flexible at the open part 130 to enable better sealing.

Figure 2:
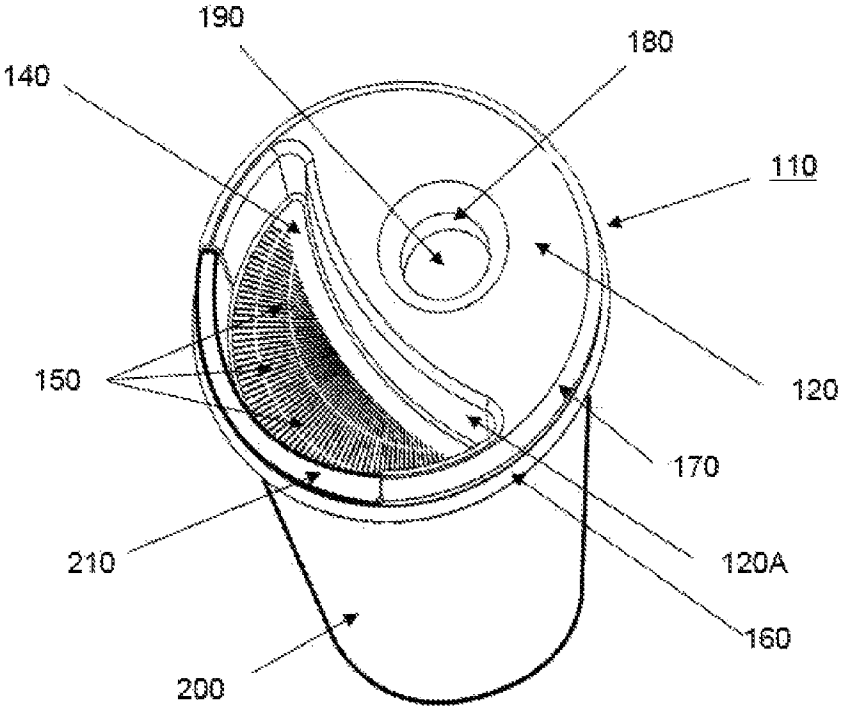
FIG. 2. Lid with slits and container, top-side view.

As shown in FIG. 2, the lid 100 is shown placed on the container 200. The portion 210 of the container 200 is also shown inserted in the open part or portion 130 of the lid. This allows the consumer to consume the content of the container with a natural flow and will therefore give a fully natural flow to the last drop.

Figure 3:
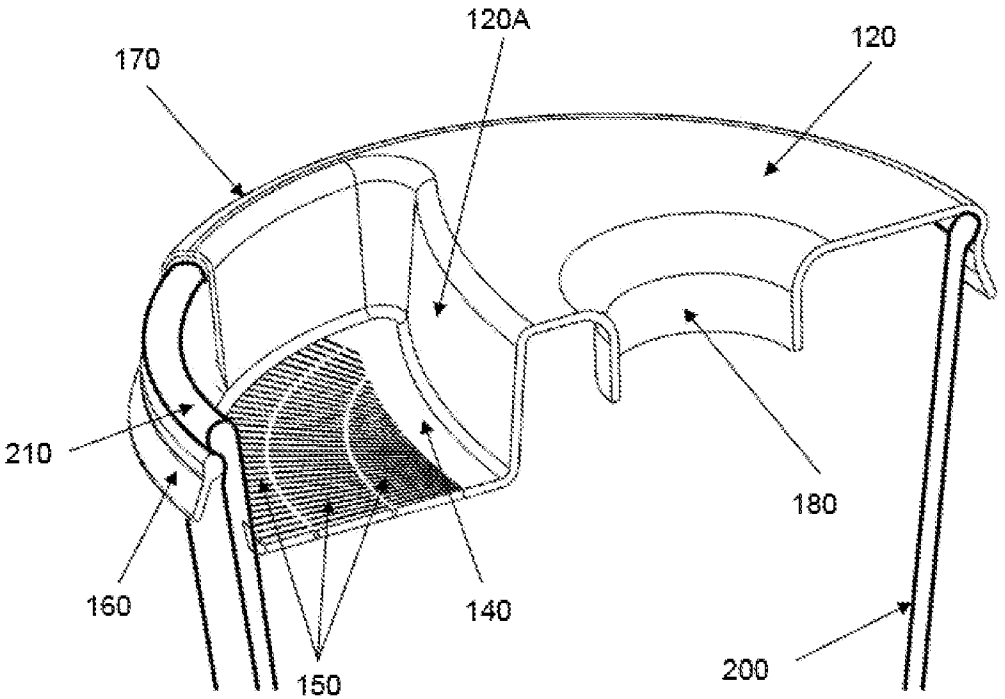
FIG. 3. Lid with slits and container, cross-section.

FIG. 3 is a schematic side perspective sectional view of the lid 100 previously shown, and art of the container 200. The same reference signs are used. The open part 30 through which the top 120 of the container is inserted is clearly shown. The lid 100 is snapped on the top 210 of the container 200 by means of the seal 170 and the fastener 160.

Figure 4:
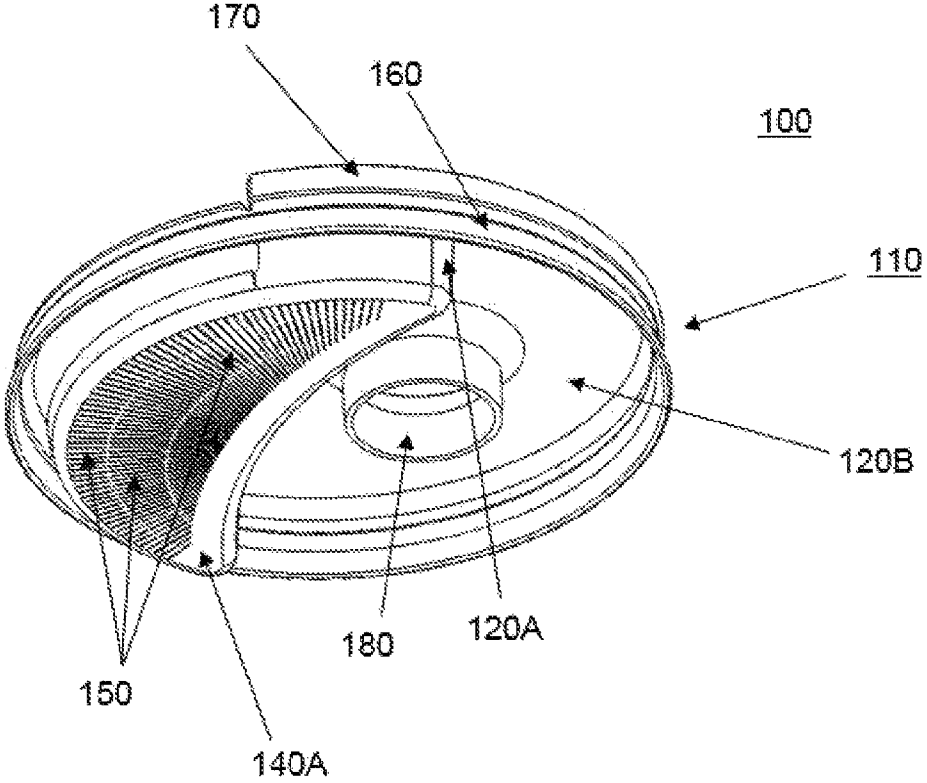
FIG. 4. Lid with slits, bottom view.

FIG. 4 depicts the underside or bottom view of the lid 100 showing the underside 120B of the top 120 and the underside 140A of the wall.

Figure 5B:
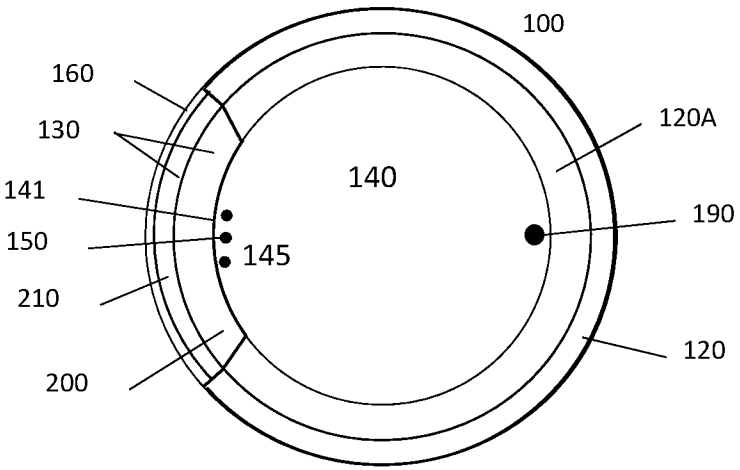
FIG. 5*b*. Lid with openings top view.
Figure 5A:
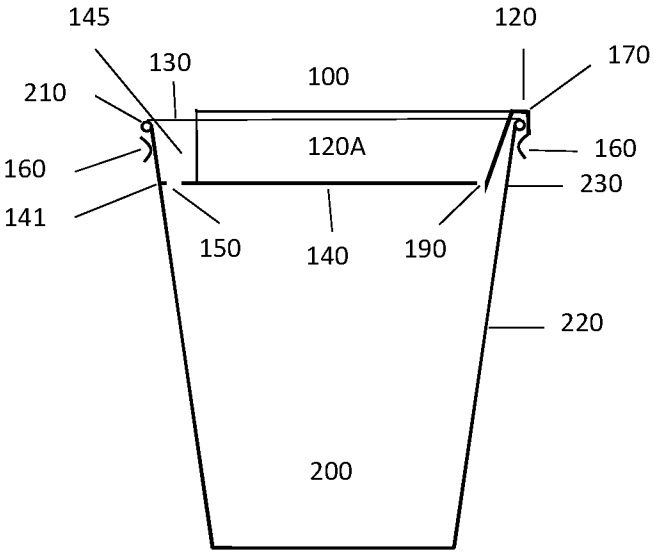
FIG. 5*a*. Container with lid with openings, side view.

Referring to FIG. 5*a* there is illustrated a side view of the container 200 and the lid 100 according to another embodiment herein. FIG. 5*b* is a top view of the lid. As shown the openings 150 are in the form of holes instead of slits. The lid 100 is attached to the container 200 and the fastener 160 secures the lid 100 to the container 200. The lid 100 acts as a seal 170 against the container 200, except for the open part 130, where the top 210 of the container 200 is exposed.

The floor 140 has preferably, but not necessarily, openings at two different places, one close to the open part 130, where the mouth for drinking is placed, and the auxiliary opening 190, which can be placed on the adjacent side of the floor. The auxiliary opening 190 can be very small, acting as a "steam" hole 190, to level out pressure differences when beverage is passing the main openings 150. The auxiliary opening 190 may also act as an aroma vapor exit for the human nose. In an embodiment the floor 140 covers almost the whole horizontal container area 230, which means the open compartment 145 will be low so a human nose will fit into the open compartment 145, and hence a reduced angle of the container is necessary during drinking. This means that the leaning of the head backwards during drinking can be reduced, which will increase the comfort of drinking.

The floor 140 is shaped to meet the wall 220 of the container 200 at the end of the floor 141.

One embodiment of the invention solves the problem with a beverage in a container having a temperature that is higher than the desired drinking temperature. With a beverage with a temperature as high as 95 degrees centigrade, cautions must be taken not to get burn. Usually, prior art has a sign "Caution contents hot", which obviously does only inform the consumer but does not solve the problem. The problem with hot beverages flushing may be solved having small openings 150 in the lid 100, where the openings will act as restriction of hot flow of beverage. The openings 150 are small to restrict flow of beverage, with typical total areas for said openings 150 between 3 to 50 $mm^2$, preferably 5 to 15 $mm^2$, and where the number of openings 150 is between 2 and 15, preferably between 2 and 5. By using multiple openings instead of one opening, leads to a higher restriction at higher flow rates, and will therefore restrict the beverage velocity, and hence reduce the risk for spill. The higher the velocity of the beverage passing through the openings, the higher the risk is for spill. A higher kinetic energy of the beverage will lead to a longer distance that the beverage may travel. With many small openings, the velocity of the beverage will be reduced, but the multiple openings will enable a wanted flowrate. By choosing dimensions of the openings and the number of openings, both beverage velocity and flow rate can be controlled as wanted. The principle is similar to a shower head, a large showerhead with many small holes will led to a small velocity of the fluid.

The problem with hot beverage during drinking is further solved by using compartment 145 formed between the floor 140 at the bottom of the lid, wall 120A of the lid, and the wall 220 of the container 200 at the partly open part 130 of the lid, where hot beverages can be collected, for sipping. The compartment is then below the top 210 of the container 200. This compartment is used to sip beverage, and hence obtain a comfortable temperature.

Hence, an advantage with the embodiment described above is to reduce the flow rate of hot leverages entering the sipping compartment (142 or 145) of the lid using small openings. Flush of (hot) beverage is avoided. Note that even if slits are used instead of small holes (openings), this advantage is achieved as long as the width of the slits are small enough as previously described.

By using the floor 140 of the lid as a cooling area, a hot beverage can effectively and fast be cooled down to, for the person, an optimal temperature. The time for cooling depends on the beverage temperature in the container, the desired drinking temperature, the volume on the lid, the beverage area on the lid, the ambient temperature, and if and how the beverage is cooled by forced air flow from the mouth. The specific heat capacity at constant pressure, denoted $c_p$, for the beverage can be regarded constant, the same as for water 4190 J/kgK. For natural convection, the heat exchange can be approximated to 5 $W/m^2K$, where the temperature difference is relative the ambient temperature. A faster cooling is obtained if the beverage is cooled by an air stream created by the mouth. Then ambient air will be mixed with the 37 centigrade breath. The mixed temperature is dependent on the flow and the distance to the object. The cooling temperature can therefore easily be regulated by the drinker. However, for simplicity, an approximate temperature of 30 centigrade can be used for cooling estimations. For a forced air stream, the heat exchange can be estimated by the convective heat transfer coefficient which is estimated to up to 25 $W/m^2K$. Despite a somewhat hotter (30 centigrade) air stream, the cooling effectivity is much higher than natural convection. For a 95 centigrade beverage, 23 centigrade ambient temperature, a forced cooling is approximately 4.5 times more effective. Still at 65 centigrade, the forced cooling is much more efficient, estimated here to 4.2 times, which is in accordance with experimental data.

The cooling time can easily be controlled by the person itself. For a 9 cm diameter lid using 80% of the surface as a cooling surface, a 95 centigrade beverage can be cooled to 65 centigrade within 5 to 10 seconds for 5 ml, just by blowing on the lid.

The floor where the hot beverage rests, will to some extent be heated by the hot beverage underneath. Experiments show that for a 95 centigrade beverage in a full container, the floor on the lid will reach a temperature of 50-60 centigrade, where the outside of an uninsulated container will reach 60-70 centigrade.

The cooling of the beverage will follow the mathematics of differential equations. The differential equation is rather complex, depending on temperature, and hence time dependent heat flux is present. The heat fluxes are:

$Q0(T_{bevereage_lid}, F, T_{air})$, convection
$Q1(T_{bevereage_lid}, T_{amb})$, conduction to air
$Q2(T_{bevereage_lid}, T_{amb})$, radiation
$Q3(T_{bevereage_lid}, T_{floor})$, conduction to floor Total heat flux $Q_{tot}$ is given by: $Q_{tot}=Q0+Q1+Q2+Q3$ Where Q0 is the dominating term.

$Q0$ is proportional to $h_c(t,F)*A*[T_{bevereage_lid}(t)-T_{air}(t)]$

Where $h_c(t)$, is the convective heat transfer coefficient, A, the one sided cooling area, $T_{bevereage_lid}(t)$, the beverage temperature on the lid, $T_{air}(t)$, the temperature of the forced air flow, $T_{amb}$ is the ambient air temperature, F, the air flow, and t, the time. As can be seen, the cooling efficiency is mainly controlled by the air flow and the temperature of the beverage. $T_{floor}$ is the temperature of the floor in the compartment, which is dependent on the beverage temperature in the container.

The temperature of the beverage on the cooling area can for simplicity be approximated with a first order differential equation:

$$T=T_0*e^{-t/Tau}$$

Where Tau is the time constant which approximately can be estimated by;

$$Tau=V*d*C_p/[h_c*0.5(T_{beverage}+T_{drink})-T_{air}]*A$$

Where $T_{drink}$ is the wanted/desired drinking temperature, V the volume of beverage on the lid, and d the density of the beverage.

Filling the cooling area/minor compartment 142 (see FIG. 6*a*-6*f*) is performed by tilting the container 200 and when the open compartment 145 on the lid is filled with beverage, the container 200 can then be tilted back and the beverage 330 will be drained back to the container 200 via openings 150 until the beverage reaches the top of a protrusion 146 (see FIG. 6*a*) with openings 150. The peripheral openings 150 are towards to the wall 220 of the container. The beverage 350 (see FIGS. 6*d*-6*f*) that is left will then be trapped on the floor 142 at the minor compartment 142 of the lid 100, ready to cool down. Tilting the container 200 again will lead the cooled beverage 350 to the opening for drinking.

To be able to fill the (minor) compartment 142, a protrusion 146 on the floor 140 is provided, to hinder that beverage 350 is drain back to the container 200. The protrusion is provided with openings 150 over the floor level 140, but the openings under the top 210 of the container 200.

If the beverage 330 (FIG. 6*d*) is very hot a smaller amount of beverage 350 (FIG. 6*e*-6*f*) can be used on the floor of the lid by directing the beverage 350 on the lid 100 to the auxiliary opening 190.

If a larger amount of beverage 350 on the floor 140 (or 142) is wanted, the lid 100 with container 200 can be twisted after tilting, leaving the openings 150 on a higher level. Another way to increase the beverage 350 volume on the minor compartment 142, is to tilt the container back fast, which means that due to the restriction in openings 150, the beverage 350 will not be completely drain back to the container 200, but be left on the minor compartment 142.

The compartment 142 hence provide a way to control the temperature of the beverage, either by letting hot beverage to cool down on the surface of the compartment or by blowing air with the mouth onto the hot beverage on the compartment. This is comparable to cooling hot soup on a spoon. The compartment 142 thus enables some part or amount of the beverage to remain in the compartment during consumption.

Figure 5C:
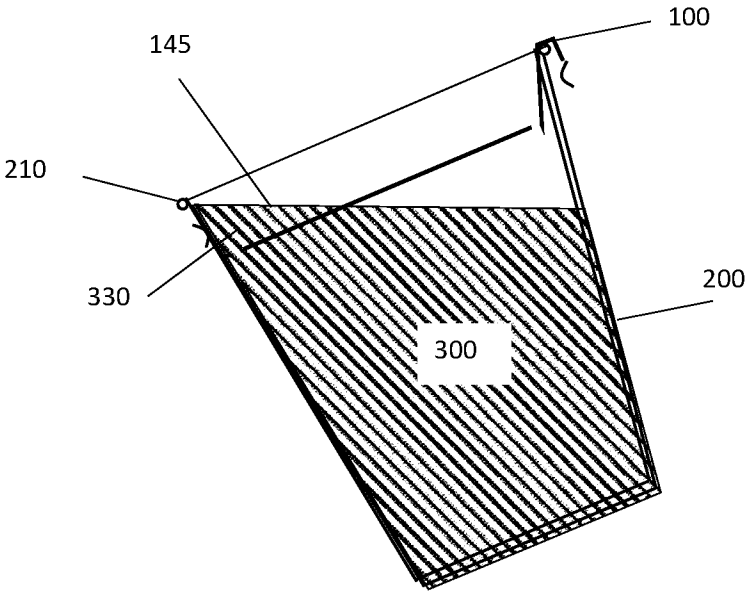
FIG. 5*c*. Tilted container with lid with openings at bottom of lid.

FIG. 5*c* shows how the compartment 145 is filled with beverage 330 from the beverage 300 in the container 200, when it is tilted. The beverage 330 in the compartment 145 can comfortably be sipped at the top 210 of the container 200. Note here that there is no protrusion 146.

Figure 6C:
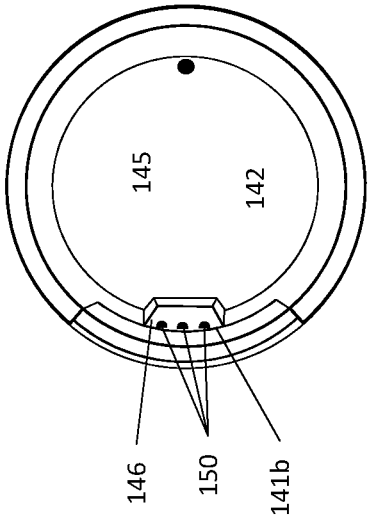
FIG. 6*c*, Lid with openings at top edge of protrusion, top view.
Figure 6B:
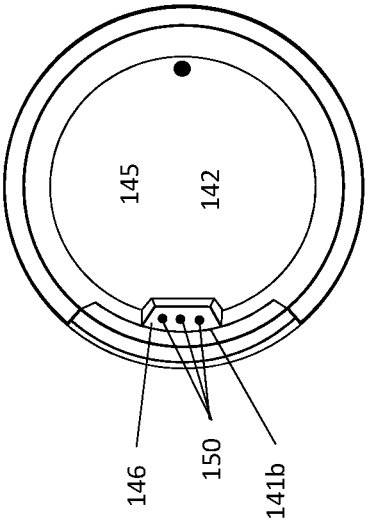
FIG. 6*b*, Lid with openings at top protrusion, top view.
Figure 6A:
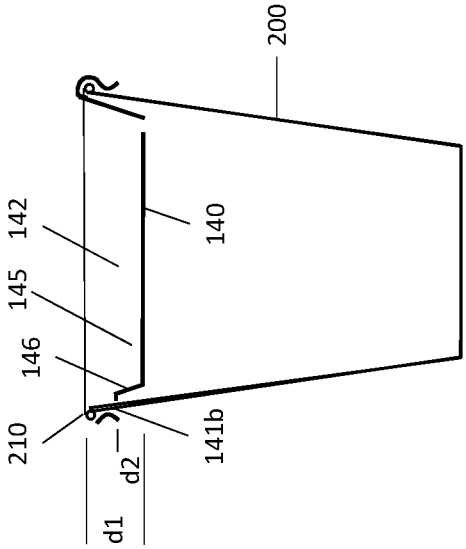
FIG. 6*a*. Container with lid with openings in a protrusion, side view.

To further improve the lid of FIG. 5, FIGS. 6*a-c* show other embodiments of the lid 100 for low flow rate. This is achieved by providing, as previously described, a protrusion 146 including the openings 150 for the beverage to pass. FIG. 6*a* shows the protrusion 146 at a height d2 over the floor 140, where d2 is less than the height d1 from the floor to the top 210 of the container 200. The protrusion 146 enables or creates together with the floor 140 a minor compartment 142 within the compartment 145 for beverage 330. FIG. 6*b* shows another embodiment where the openings 150 for beverage are within the upper part of the protrusion. FIG. 6*c* shows an embodiment where the openings 150 for beverage is/are at the end 141*b* of the upper part of the protrusion 146 i.e. close to the wall of the beverage container when the lid is in place, which means all beverage 300 can be easily emptied from the container 200. When the lid 100 is inserted on the container 200, the openings 150 are preferably positioned close to the wall 220 of the container e.g. between 0-3 mm, preferably 0-2 mm.

Figure 6F:
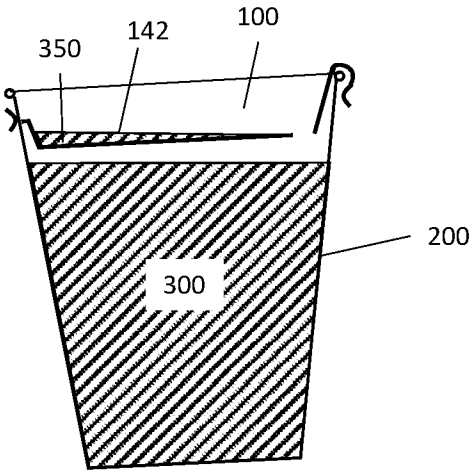
FIG. 6*f*. Container with lid with openings at protrusion, tilted back leaving beverage on the lid, side view.
Figure 6E:
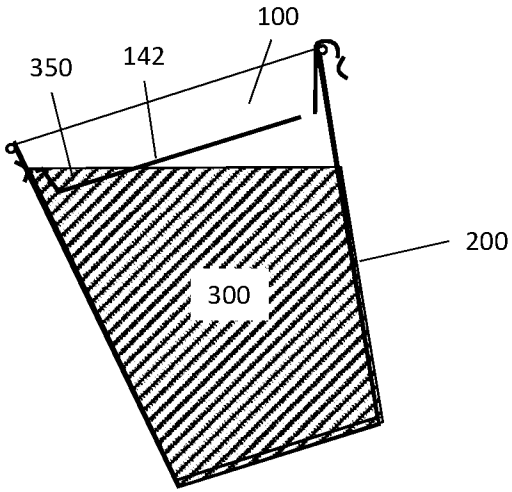
FIG. 6*e*. Tilted container with lid with openings at protrusion, beverage reaching top of the protrusion, side view.
Figure 6D:
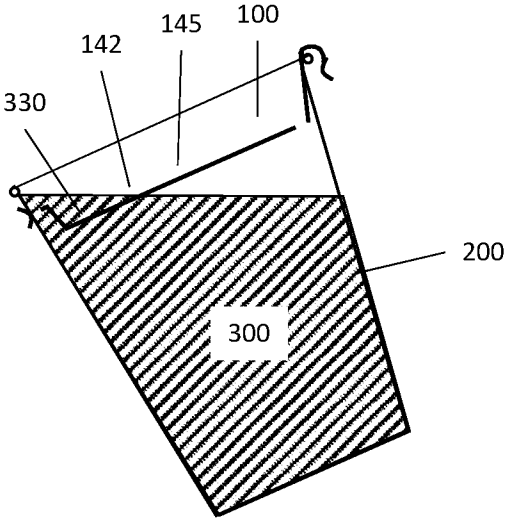
FIG. 6*d*, Tilted container with lid with openings at protrusion, beverage reaching top of the container wall, side view.

FIGS. 6*d-f* show how the minor compartment 142 for cooling of the beverage 330 is filled. First, the container 200 has to be tilted at an angle large enough that the beverage pass the openings 150 in the protrusion 146 (see FIG. 6*d*). Then the minor compartment 142 will start to fill. When the container 200 is tilted back, beverage 350 will drain back to the beverage 300 in the container 200, until the level reach the top of the protrusion 146 (FIG. 6*e*). When the container 200 is further tilted back, a beverage volume 350 will be trapped in the minor compartment 142 (FIG. 6*f*). The beverage 350 in the minor compartment can easily be cooled down by the air flow from the drinker, which is a natural behavior, similar to cooling down soup on a spoon. The force and the time will define the cooling power. The trapped beverage 350 in the minor compartment can also be cooled down without forced air convection. The natural cooling convection by 5 W/m2K and radiation cooling will cool the trapped beverage, but at a slower rate. When the container 200 is again tilted, the trapped and cooled beverage will enter the drinking area, mixed somewhat with the beverage 300 from the container 200. The height d2 of the protrusion 146 relative the height d1 from the floor 140 to the top 210 of the container 200, will control the mixing between cooled 350 and hot 300 beverage. The higher (distance d2) the protrusion 146 is the less hot beverage 300 will be mixed with the cooled beverage 350.

Figure 7B:
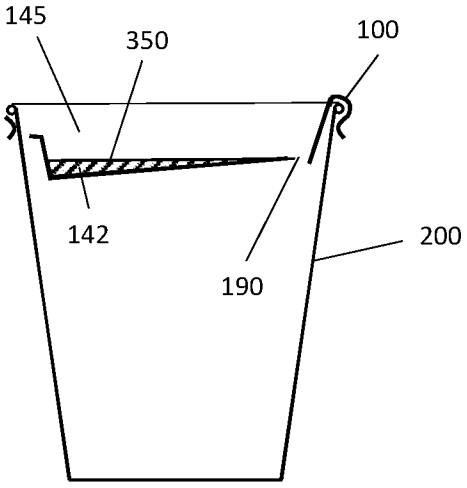
FIG. 7*b*, Container with lid with openings and floor leaning towards the protrusion, and container placed horizontally, side view.
Figure 7A:
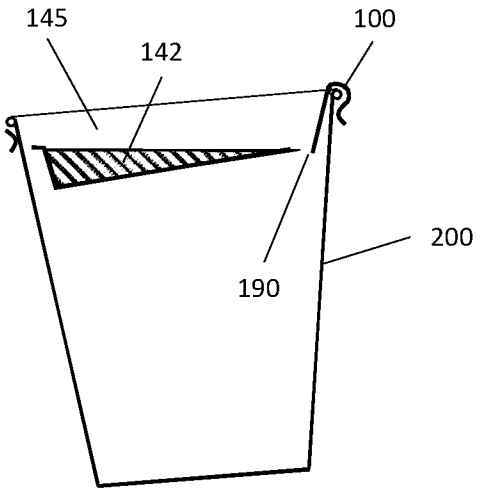
FIG. 7*a*, Container with lid with openings and floor leaning towards the protrusion, and container tilted, side view.

FIGS. 7*a-b* show an embodiment where the minor compartment 142 for cooled beverage 350 leans toward the protrusion 146, letting the trapped beverage 350, still be trapped when the container 200 is placed horizontally (FIG. 7*b*).

Figure 8B:
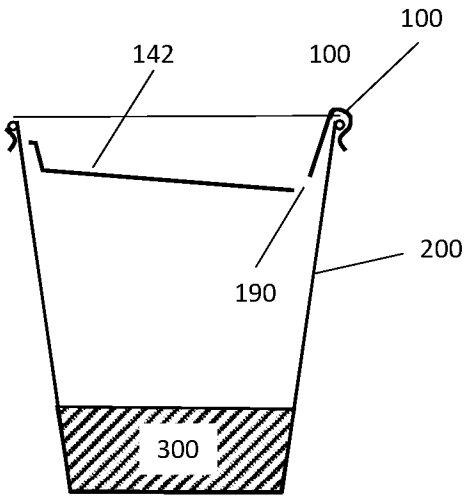
FIG. 8*b*. Container with Lid with openings and floor leaning from the protrusion, and container placed horizontally, side view.
Figure 8A:
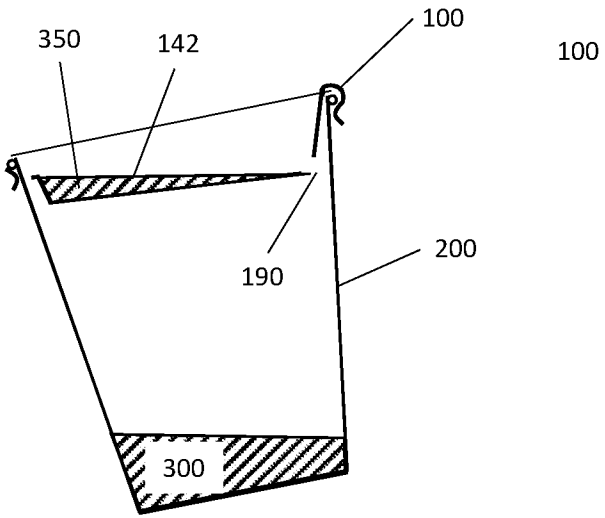
FIG. 8*a*. Container with lid with openings and floor leaning from the protrusion, and container tilted, side view.

FIGS. 8*a-b* show an embodiment where the minor compartment 142 for cooled beverage 350 leans backwards from the protrusion 146, letting the trapped beverage 350 to be drained to the beverage 300 in the container 200 by means of the auxiliary opening 190, when the container 200 is placed horizontally (FIG. 8*b*).

Figure 9B:
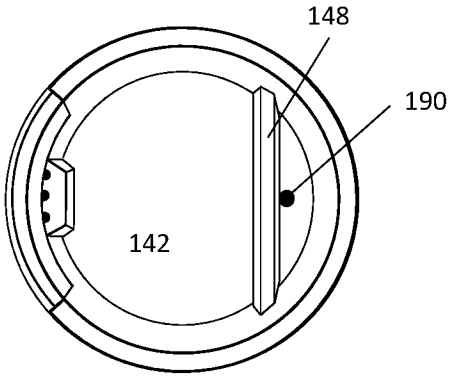
FIG. 9*b*, Lid with openings and floor with a wall, top view.
Figure 9A:
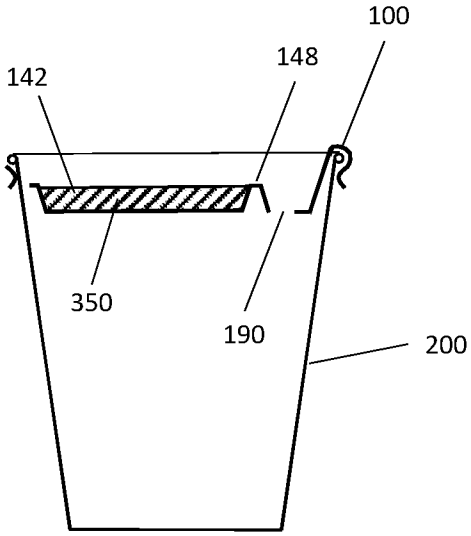
FIG. 9*a*. Container with lid with openings and floor with a wall, side view.

FIG. 9*a*-9*b* show an embodiment where the minor compartment 142 for cooled beverage 350 is trapped by a protrusion wall 148, letting the trapped beverage to be trapped even if the container 200 is tilted somewhat from the horizontally position. Hence, the lid is provided with a protrusion wall 148 to isolate the minor compartment 142 from the auxiliary opening 190 of the lid 100.

Figure 10B:
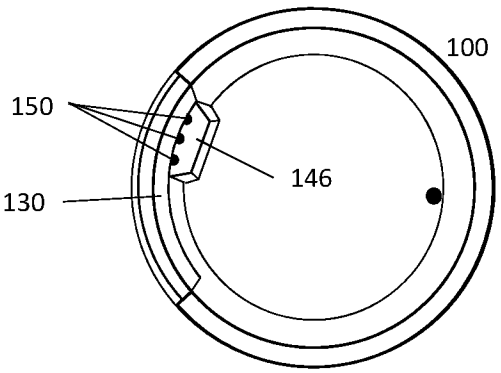
FIG. 10*b*. Lid with an asymmetrical placed protrusion with openings, top view.
Figure 10A:
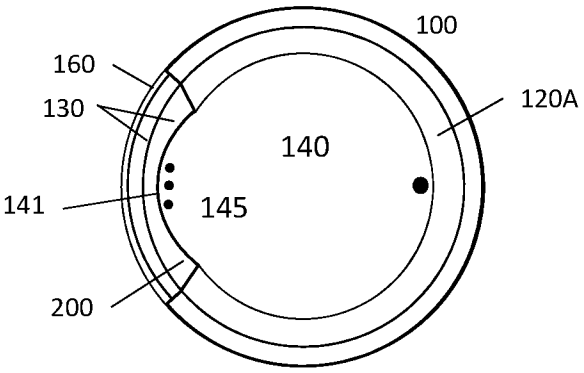
FIG. 10*a*. Lid with an extended oval shaped floor.

FIG. 10*a* shows an embodiment of the lid 100 wherein has an oval form towards the open part or opening 130 against the wall of the container 200. The floor 140 extending more than the nominal radius dimension of the corresponding container, to enhance sealing at the edge 141 of the floor or protrusion. This will eliminate or reduce possible gaps between the floor 140 and the wall 220 if e.g. partial deformation and/or deviation from the container's nominal dimension is present and therefore a better sealing between the floor 140 and the wall 220 is achieved. The shape of the floor or protrusion is, as described, preferably somewhat oval at the edge 141. Because of the relatively larger dimension of the floor 140 at the edge 141, at the opening 130, the tightest fit between the lid 100 and the container 200 will likely be at the open part 130. Further, the openings 150 are an open structure placed at the end position 141/141*b* (see FIG. 11*a*) of the floor 140.

FIG. 10*b* shows the lid 100 with a protrusion 146 with openings 150 for beverage asymmetrically positioned relative the open part 130 of the lid 100. This means that a larger volume of beverage 350 can be trapped on the lid 100. The openings in embodiments of the present invention provide restriction to particles, if any, contained in the beverage to be consumed such as coffee grains.

Figure 11B:
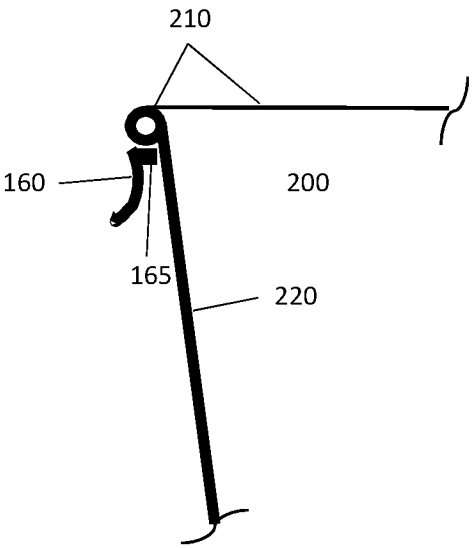
FIG. 11*b*. Lid with a ridge on the fastener, side view.
Figure 11A:
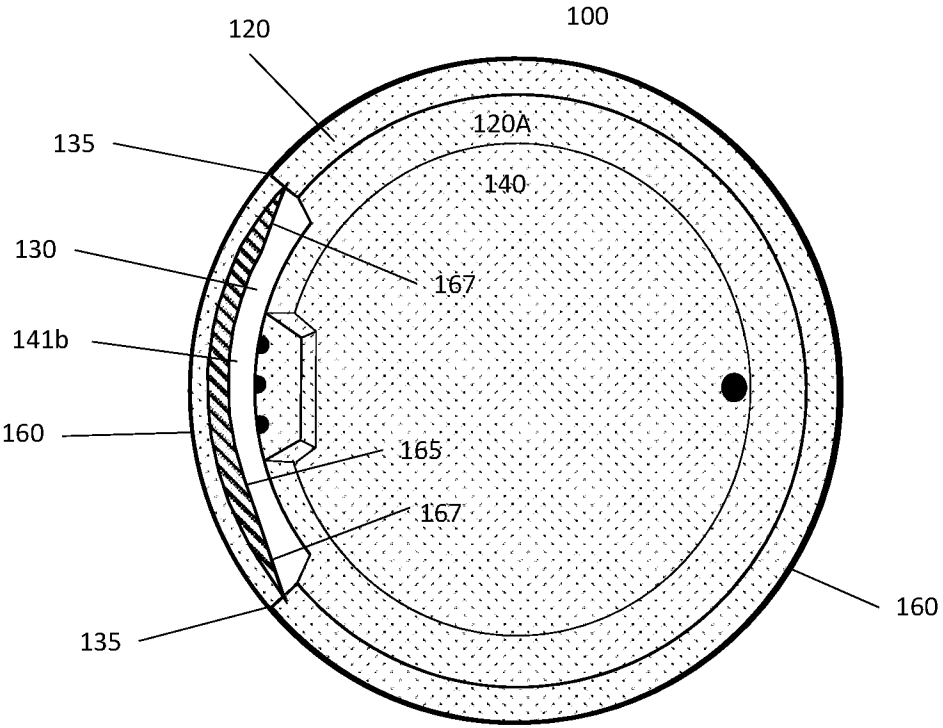
FIG. 11*a*. Lid with a ridge on the fastener, top view.

FIG. 11*a-b* shows a lid where the fastener 160 comprises a ridge 165 to enhance the fit of the edge 141 or 141*b* of the floor or protrusion respectively. The ridge 165 will snap under the top 210 of the container 200 making a safer attachment of the lid 100 and enable a better sealing of the edge of the floor or protrusion 141/141*b*. The ridge 165 at the fastener has preferably smaller dimensions towards the end 135 of the part 130 of the lid 100, to enable easier attachment of the lid 100, and to reduce stress of the material when the lid 100 is inserted or taken off the upper part 210 of the container 200. The ridge 165 can in an embodiment displace only a part of the open part 130 of the lid 100.

Hence, the ridge 165 is placed inwards on the fastener at the open position of the lid 100, means that the fastener will squeeze tightly to the outside of the container's wall. The ridge 165 has two functions, 1) ensure that the container's wall will not flex from its nominal position, which could lead to a gap between the floor of the lid inside the container and the container's wall. With nominal position or dimension, means the geometrical dimensions for the container without any deformation, due to stress or other factors, i.e. a circular container assumes to be circular. However, generally the container will to some extent be deformed, either by forces or by its production process, e.g. the circular shape can be somewhat oval, 2) ensure that the fastener is hold in place under the rim of the container to ensure save attachment of the lid. Because there is no material above the fastener, the fastener is more prone to flex at this position, which could lead to an unsecure fit of the lid. However, the ridge will grab under the rim, safely position the lid on the right position with little risk that the fastener will slip over the rim. The lid 100 is also shown having a smaller depth 167 at the end of the ridge 165.

Figure 12B:
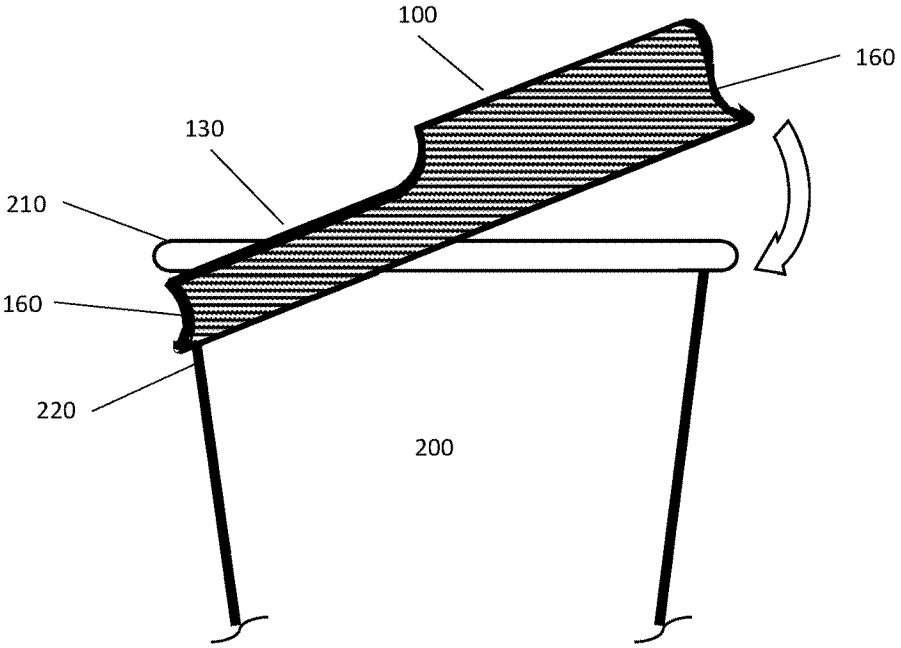
FIG. 12*b*. Insertion of lid, side view.
Figure 12A:
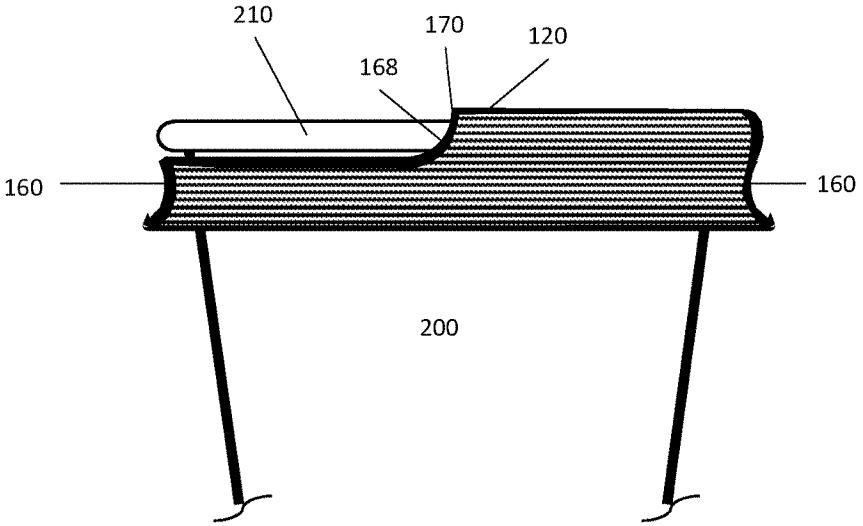
FIG. 12*a*. Lid with a stress relief, side view.

FIG. 12*a* shows a smooth transition 168 between the fastener 160 and the top 120 of the lid 100 to reduce material stress when the lid 100 is inserted or taken off.

FIG. 12*b* shows how the fastener 160 of the lid is inserted under the top 120 of the container 200 during attachment of the lid 100 to the container 100. Because the lid 100 has an open structure 130, the lid 100 and the container 200 will flex during insertion of the lid 100, reducing the insertion force, but no flex is possible when the lid is inserted FIG. 12*a*, because the fastener 160 surrounds the container 200. Because of the natural flex and a low insertion force, a stiffer fastener 160 can be used, and hence a more secure attachment of the lid 100 to the container 200 is possible.

It should be mentioned that a fastener that squeezes the outside of the container's wall will increase the force to remove the lid from the container. Most containers are circular shaped with a rim on top, which means that a fastener snapped at the upper part of the wall under the rim will be more safely attached. When the fastener completely surrounds the circumference, i.e. the fastener is circular, the attachment is further enhanced. Because the invention incorporates an open part at the drinking position at the container's rim, the fastener can be thread on at this position, where the lid is placed at an angle, e.g. 20 to 60 degrees, with the fastener under the rim, and then fold down (as shown in FIG. 12*b*) with a "click". Because the container can flex when the lid is not on, the force to thread on the lid at an angle will be rather small, and when the fastener on the open part is in place under the rim, the lid is easily snapped on the rim.

Figure 13:
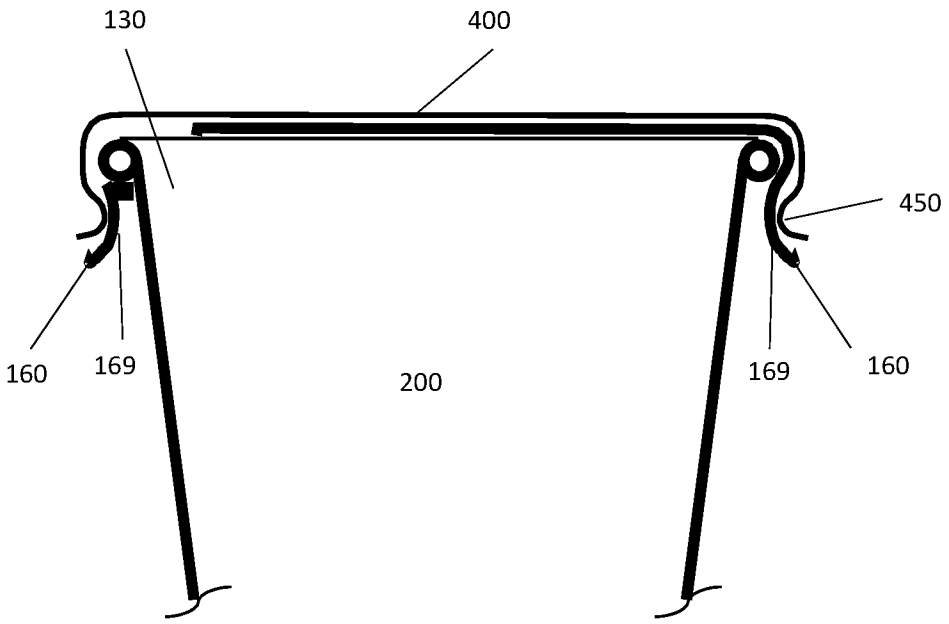
FIG. 13. Lid with an auxiliary lid or cover.

FIG. 13 shows another embodiment, where an auxiliary lid 400 is provided to be placed on the lid 100 to reduce the risk for spillage of beverage during transportation. The auxiliary lid 400 will further help insulation and slow down cooling of the beverage in the container. The (main) lid 100 is equipped with a concave portion 169 on the fastener 160 to meet a convex portion 450 on the auxiliary lid 400.

Figure 14B:
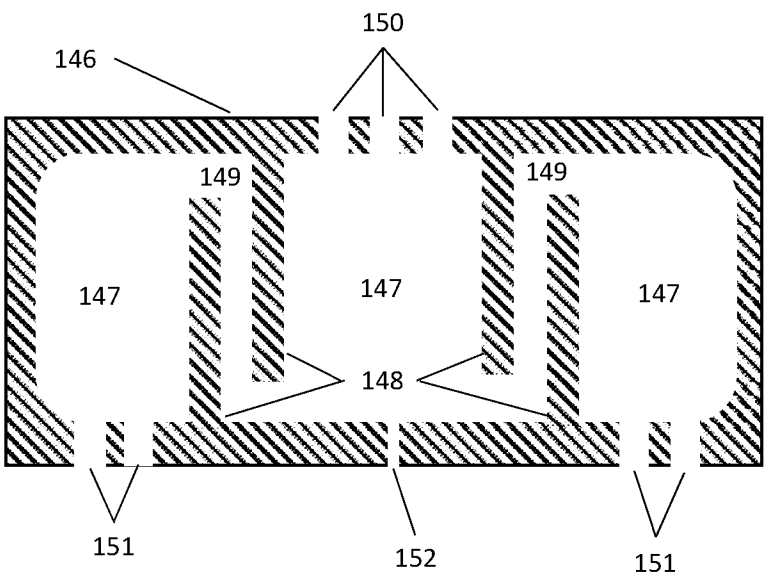
FIG. 14*b*. Protrusion in lid with a series of cavities.
Figure 14A:
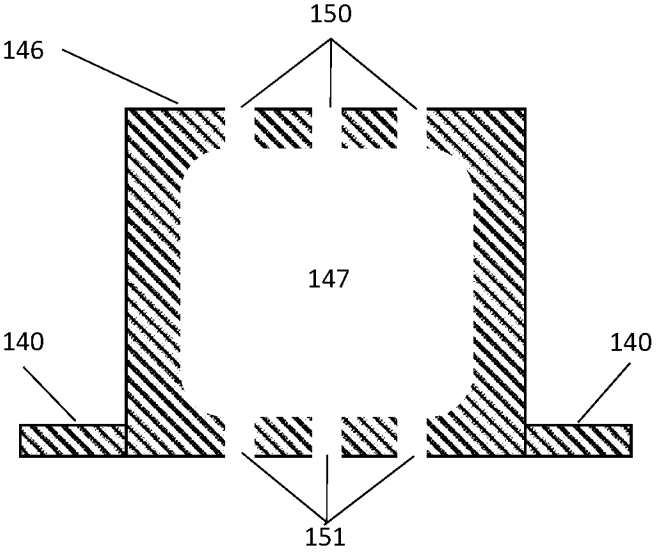
FIG. 14*a*. Protrusion in lid with a cavity.

FIG. 14*a* shows the protrusion 146 acting also as a splash guard by incorporating a cavity 147 between outlet openings 150 and inlet openings 152 from the underside. If beverage is forced toward the lower openings 151, flow will be restricted and slowly fill the cavity 147. Any forced flow will be damped in the cavity. The small openings 150/151 and the cavity 147, will act as a (fluidistic) low pass filter. As shown, the openings 150 are connected to the cavity which is provided with openings for the inner part of the container where the beverage is stored.

FIG. 14*b* shows a more effective splash guard by incorporating restrictions 150/151 and cavities 147 in series, with an intermediate restriction 149 between the cavities 147. The intermediate restrictions have vertical channels which mean that the first cavity 147 has to be full before the next cavity 147 is filled. Intermediate cavities can be drained by a little opening 152, not to be saturated with beverage.

Figure 14D:
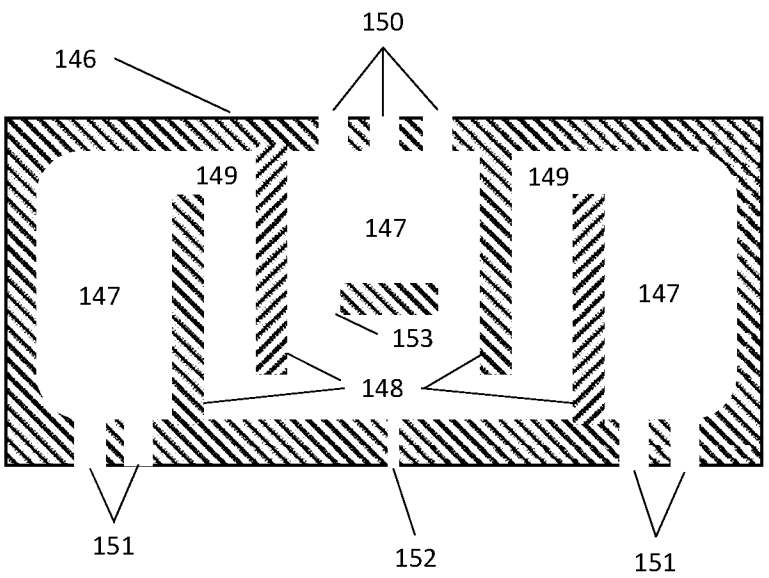
FIG. 14*d*. Protrusion in lid with a series of cavities and splash guard.
Figure 14C:
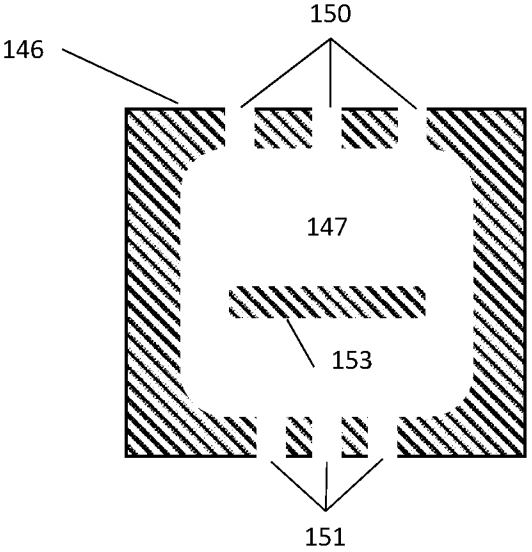
FIG. 14*c*. Protrusion in lid with a cavity and splash guard.

FIG. 14*c*-*d* shows another embodiment of protrusion 146 including the cavity 147. As shown, the cavity 147 comprises at least one splash guard 153 to hinder injected beverage from lower openings 151, 152 to propagate out of the protrusion.

Each cavity 147 is shown comprising a connection 149 formed by at least protrusion wall 148 in order to isolate the compartment 142 from the auxiliary opening 190 of the lid 100. In FIG. 14*d*, the protrusion 146 is shown provided with a series of cavities divided by the connection 149 created by the walls 148. The openings 150, previously described, are attached or connected to the cavity(ies) 147.

Figure 14F:
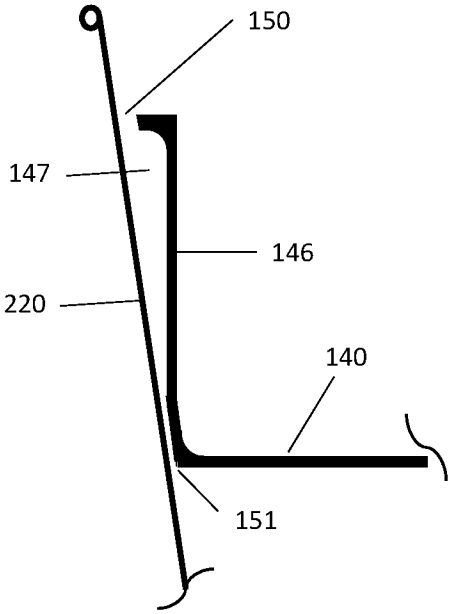
FIG. 14*f*. Protrusion in lid with a cavity with a draft for mold, side view.
Figure 14E:
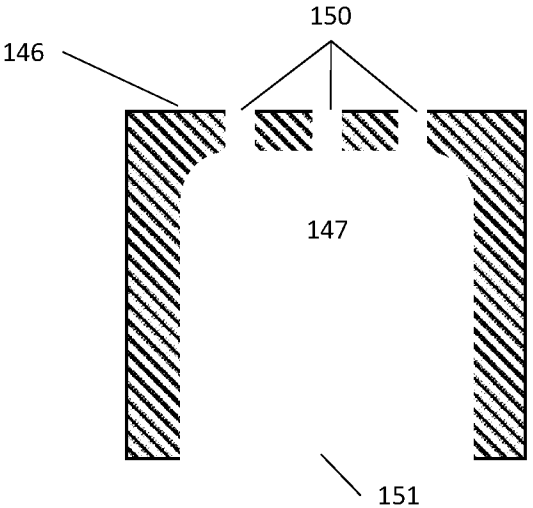
FIG. 14*e*. Protrusion in lid with a cavity with a draft for mold, front view.

FIG. 14*e*-*f* show another embodiment of a splash guard that can be produced by vertical tooling, creating a wedge shaped cavity 147 in the protrusion 46.

Figure 15B:
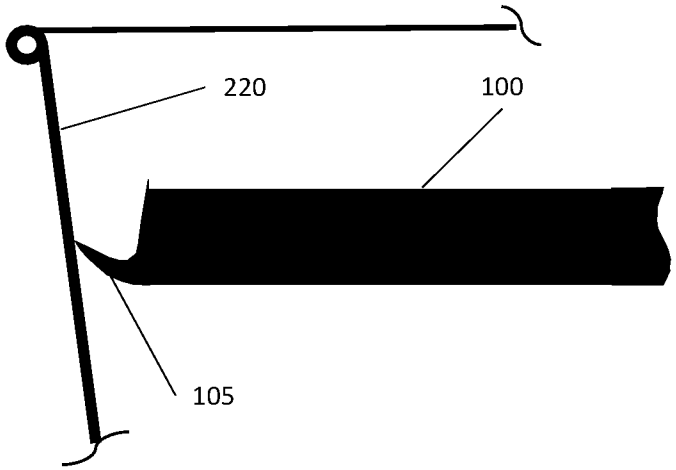
FIG. 15*b*. Flexible edge of lid against the container wall.
Figure 15A:
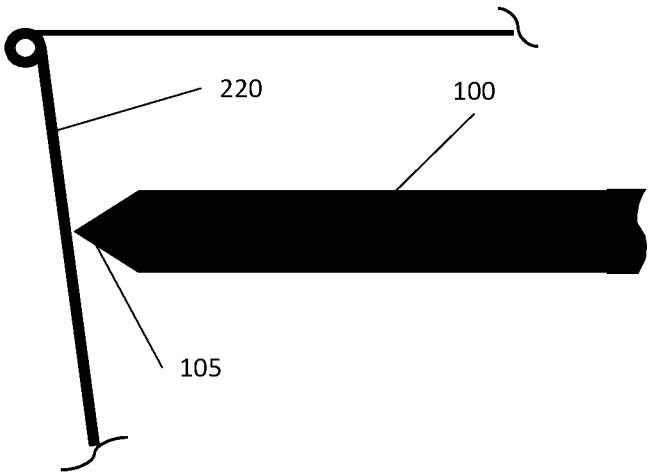
FIG. 15*a*. Sharp edge of lid against the container wall.

FIG. 15*a* shows a sharp edge 105 of the lid 100 preferably at the open part 130 to create a better seal between the lid 100 and the container 200. The sharp edge 105 creates a higher sealing pressure between the lid and the container 200 or container wall 220.

FIG. 15*b* shown another embodiment of the edge 105 which is flexible. Also in this case the flexible edge 105 creates a better seal between the lid 100 and the container 200 and a higher sealing pressure between the lid and the container 200 or container wall 220.

Figure 16D:
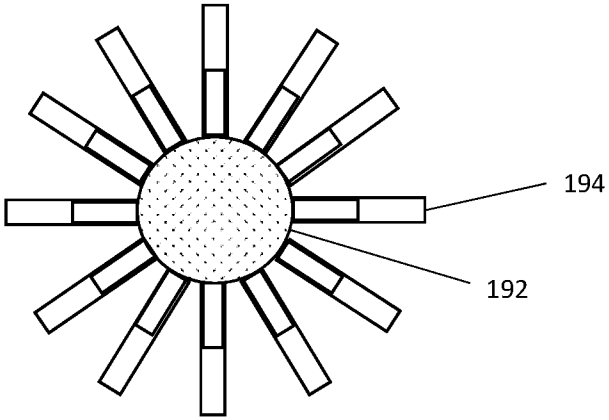
FIG. 16*d*. Lid/cover over auxiliary opening, top view.
Figure 16A:
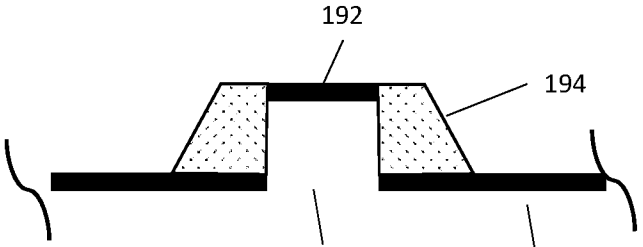
FIG. 16*a*. Lid/cover over auxiliary opening, side view.
Figure 16B:
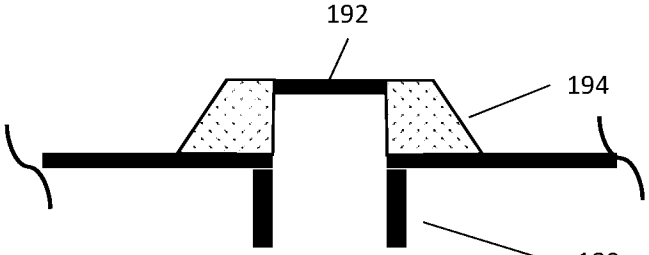
FIG. 16*b*. Lid/cover over auxiliary opening, side view.
Figure 16C:
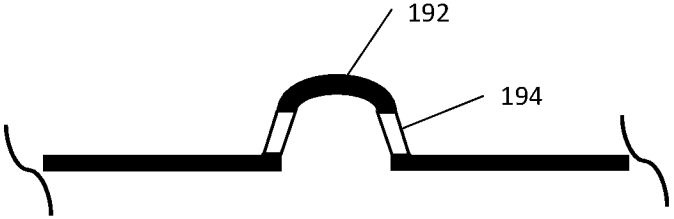
FIG. 16*c*. Domed lid/cover over auxiliary opening, side view.

As previously described, the lid 100 comprises an auxiliary opening 190. In this embodiment, a lid 192 is provided over the opening 190 as shown in FIGS. 16*a*-16*c*. Such a lid 192 hinder beverage to be rejected (or injected upwards) at movement of the container or when the container squeezed. The lid 192 may be attached to the floor 140 of the lid 100 by posts 194.

FIG. 16*b* shows the lid 192 being equipped with walls (or a tube) 180 to be introduced in the auxiliary opening 190. FIG. 16*c* shows a dome shaped lid 192, and FIG. 16*d* shown an upper view of the lid 192 and the post 194.

The previously described embodiments provide many advantages and features which include:

- Enabling natural sipping from the container, e.g. flow of small amount of beverage can easily be controlled by the drinking person, and by blowing with the mouth, hot beverage can be cooled off with cold air, which is the natural way to drink not beverages.
- Reducing the flow rate of hot beverage entering the sipping compartment of the lid/container using small openings. No flush of hot beverage is then possible.
- No leakage of beverage between the lid and the container, because there is no seal the beverage has to pass by during drinking.
- No leakage of beverage if the lid and the container separate, due to the fact that drinking is only performed directly to the container.
- Low insertion force of the lid, but secure attachment due to a ridge on the fastener and an open part on the lid.
- Secure attachment of the lid because a stiffer fastener can be used because the structure enables a low insertion force.
- Possibility to use the minor compartment in the lid to control the temperature, either by letting the hot beverage cool at the surface, or more effectively by blowing air with the mouth onto the hot beverage on the minor compartment, like the natural thing to cool hot soup on a spoon. The temperature reduction is easily controlled by time and blowing force.
- Openings placed at the end of the lid's floor enables all beverage to be consumed, no beverage has to be trapped in the container.
- The invention's structure enables a splash proof solution, where beverage cannot splash through the openings due to hydrodynamic low pass filter for the beverage outlet. a small "steam hole" and
- Splash proof auxiliary opening by using a lid to stop splashes.
- Almost leakage proof solution with an auxiliary simple lid without openings that is temporarily attached over the main lid during transportation.
- An auxiliary lid, not only eliminates spill during transportation, but also increases the insulation, which keep the temperature of the beverage for a longer time.
- An extra lid over the auxiliary opening to reduce to hinder ejection of the beverage during (sudden) movement of the container or when the container is squeezed.

Additional advantages and features of the embodiments herein have already been described and need not be repeated.

The invention is not limited by the embodiments shown. For instance, the container could have any shape, square, oval, etc. The openings for beverage can have arbitrary shapes.

The invention claimed is:

1. A disposable lid for a container for a beverage, the disposable lid comprising:

a seal, and a fastener to be placed under a top of the container to enable attachment of the disposable lid to the container;

the disposable lid forming an open compartment at least partly inside the container when placed on the container;

the open compartment:

being positioned below the top of the container when the disposable lid is attached to the container;

extending to a top of the seal;

having a floor comprising a plurality of openings, enabling the beverage to pass through the openings;

being partly open to a wall of the container when the disposable lid is attached to the container, enabling a person's lips to be in contact with the top of the container during consumption of the beverage; and the fastener surrounding an outside at an upper part of the wall of the container below the top of the container.

2. The disposable lid according to claim 1, wherein the floor partly extends longer than a radius of the container at the floor, at a position of a partly open part of the disposable lid, without the disposable lid attached.

3. The disposable lid according to claim 1, wherein the floor has an oval form towards the opening against the wall of the container when the disposable lid is attached to the container.

4. The disposable lid according to claim 1, wherein the plurality of openings provide restriction to the beverage.

5. The disposable lid according to claim 1, wherein the plurality of openings, when the disposable lid is attached, are positioned at a distance from the wall of between 0 to 3 mm.

6. The disposable lid according to claim 5, wherein the plurality of openings form slits.

7. The disposable lid according to claim 6, wherein the slits are narrow openings between 0.1 mm to 0.5 mm.

8. The disposable lid according to claim 6, wherein the slits are distributed over an area which is between 5% and 100% of a horizontal area of the container when the disposable lid is attached to the container.

9. The disposable lid according to claim 6, wherein the slits are positioned, at 3 mm from the container wall when the disposable lid is attached to the container.

10. The disposable lid according to claim 6, wherein the slits are wedged formed having wedge angles between 70 degrees and 90 degrees.

11. The disposable lid according to claim 1, wherein the plurality of openings are an integrated part of the disposable lid.

12. The disposable lid according to claim 1, further comprising a minor compartment included in the open compartment, the minor compartment being above the floor, wherein the minor compartment enables some part of the beverage to remain in the minor compartment during consumption.

13. The disposable lid according to claim 12, wherein the floor is provided with a protrusion reaching above the open compartment, but below the top of the container, and the protrusion comprises the openings for the beverage to pass.

14. The disposable lid according to claim 1, wherein the openings are configured to restrict flow of beverage, the openings having a total area between 3 to 50 $mm^2$.

15. The disposable lid according to claim 14, wherein the openings are connected to at least one cavity, and wherein the openings are an open structure placed at an end position of the floor.

16. The disposable lid according to claim 15, wherein the at least one cavity is provided with openings for an inner part of the container.

17. The disposable lid according to claim 15, wherein said at least one cavity comprises at least one splash guard.

18. The disposable lid according to claim 15, wherein each of the at least one cavity comprises a connection formed by at least one protrusion wall to isolate the open compartment from an auxiliary opening of the disposable lid.

19. The disposable lid according to claim 1, wherein the fastener comprises a ridge for engaging the disposable lid to the container.

20. The disposable lid according to claim 14, wherein the openings are connected to at least one cavity.

* * * * *